United States Patent [19]

Horovitz

[11] Patent Number: 4,864,738

[45] Date of Patent: Sep. 12, 1989

[54] SOLE CONSTRUCTION FOR FOOTWEAR

[76] Inventor: Zvi Horovitz, 21 Marie Dr., Andover, Mass. 01810

[21] Appl. No.: 221,328

[22] Filed: Jul. 19, 1988

[51] Int. Cl.[4] ..... A43B 13/20

[52] U.S. Cl. ..... 36/29; 2/413

[58] Field of Search ..... 36/28, 29, 32 R, 88, 36/91; 2/413, 22

[56] References Cited

U.S. PATENT DOCUMENTS

| | | | |
|---|---|---|---|
| 1,498,838 | 6/1924 | Harrison | 36/29 |
| 1,596,923 | 8/1926 | Cooney | 36/29 |
| 2,121,702 | 6/1938 | Larkin | 2/413 |
| 2,627,676 | 2/1953 | Hack | 36/29 |
| 3,005,272 | 10/1961 | Shelare | 36/29 |
| 4,297,797 | 11/1981 | Meyers | 36/29 |
| 4,593,482 | 6/1986 | Mayer | 36/29 |

FOREIGN PATENT DOCUMENTS

| | | | |
|---|---|---|---|
| 996111 | 12/1951 | France | 36/29 |
| 1603646 | 11/1981 | United Kingdom | 36/29 |

*Primary Examiner*—Werner H. Schroeder

*Assistant Examiner*—D. Biefeld

*Attorney, Agent, or Firm*—Edward A. Gordon

[57] ABSTRACT

A composite sole structure for footwear and the like is disclosed. The sole structure includes a plurality of adjacent tubular members adapted to contain a gaseous medium under pressure at a selected value. The tubular members are provided with a composite structure including an inner layer of resilient elastomeric material impermeable to diffusion of the gaseous medium therethrough; an outer layer of a flexible mesh material resistant to expansion but sufficiently compliant to cooperate with the inner resilient layer to provide a cushioning effect in response to shock forces and a resilient flexible material forming a matrix about the tubular members. In an alternate embodiment aa second or outer layer of a resilient elastomeric material is provided over the flexible mesh layer to provide additional strength and resistance to diffusion of gases. The tubular members can be varied in length, size, and configuration and can be constructed and arranged to run lengthwise (toe to heel), transversely, and diagonally thereof and in a serpentine-like configuration within the sole matrix.

28 Claims, 4 Drawing Sheets

SOLE CONSTRUCTION FOR FOOTWEAR

BACKGROUND OF THE INVENTION

1. Field of the Invention

The present invention relates to footwear and more particularly to a new and improved shock absorbing sole construction which is particularly useful for athletic shoes and the like.

2. Description of Prior Art

The modern athletic shoe is a highly refined combination of many elements which have specific functions, all of which must work together for the support and protection of the foot during an athletic event. The shoe is divided into two general parts, an upper and a sole. The upper is designed to snuggly and comfortably enclose the foot. Typically, it will have several layers including a weather-and-wear resistant outer layer of leather or synthetic material such as nylon, and soft padded inner liner for foot comfort. Current uppers typically have an intermediate layer of a synthetic foam material. The three layers of the upper may be fastened together by stitching, gluing or a combination of these. In areas of maximum wear or stress, reinforcements of leather and/or plastic are attached to the upper.

The other major portion of the athletic shoe is the sole. Designed to withstand many miles of running, it must have an extremely durable bottom surface to contact the ground. However, since such contact may be made with considerable force, protection of the foot demands that the sole also perform a shock absorbing function. This shock absorbing function has been typically performed by a resilient, energy-absorbing material, which is located as a midsole between the durable lower surface material, i.e., the outer sole and the upper. This is particularly true for training or jogging shoes designed to be used over long distances and over a long period of time.

Foot comfort for the athlete and for those who jog or walk briskly for general exercise has been the target of many and varied proposals for shoe construction. And the broad concept of using a pneumatic cushion as part of the heel and/or sole construction has been known for the better part of a century, illustratively through King U.S. Pat. Nos. 541,814 of 1895 and Maddocks 1,011,460 of 1911. In more recent years, efforts have been directed to providing substantially uniformly absorbent action along the full length of the foot, either by employing specially fabricated pneumatic sheet material (as in Sindler U.S. Pat. 2,100,492), or by incorporating a full-length inflatable bladder in the sole (as in Reed U.S. Pat. Nos. 2,677,904 and in Cortina 2,863,230), or by providing an outsole with a substantially uniform distribution of air-filled cavities over the full area of the sole (as in Gardner U.S. Pat. Nos. 4,012,855, Petrosky 4,129,951, Khalsa, et al. 4,133,118, Moss 4,170,078, and Doak 4,397,104), or by providing a tread characterized by a distributed plurality of resilient "posts" served by interconnecting channels and a common source of pneumatic pressure (as in Muller U.S. Pat. No. 4,319,412).

Other examples of the state of the art employing various pneumatic supports can be seen in the following U.S. Pat. Nos.:

| | |
|---|---|
| 4,610,099 | 4,271,606 |
| 4,462,171 | 4,219,945 |

-continued

| | |
|---|---|
| 4,297,797 | 4,183,156 |

While the foregoing prior art patents provide improvement in the areas intended, there still exists a great need to provide an improved pneumatic shock absorbing sole construction offering maximum resistance to deformation while providing high flexibility.

Accordingly, a principal desirable object of the present invention is to provide an improved construction for pneumatic or fluid filled soles having improved shock absorbing action.

Another desirable object of the present invention is to provide a fluid-filled sole which provides varying degrees of shock absorption or cushioning as needed in various parts of the sole.

Another desirable object of the present invention is to provide an improved pneumatic sole construction having improved shock absorbing resilience to the high impact forces encountered by an active person when walking, running or jumping.

Another desirable object of the present invention is to provide an improved pneumatic or fluid-filled sole construction which minimizes fluid loss.

A still further desirable object of the present invention is to provide an improved pneumatic sole of the above desirable objects which provides a relatively simple structure, lending itself to inexpensive mass-production.

SUMMARY OF THE INVENTION

The present invention discloses a shock absorbing or attenuating sole construction for footwear. The shock attenuating sole structure of the present invention comprises a plurality of adjacent tubular members adapted to contain a gaseous medium under pressure at a desired selected value. The tubular members have a composite structure comprising an inner layer of flexible resilient material impermeable to diffusion of gaseous fluids therethrough, an outer layer of a flexible material resistant to expansion but sufficiently compliant to cooperate with the inner flexible, resilient layer to provide a cushioning effect in response to shock forces, and a flexible, resilient material forming a matrix about the tubular members.

The inner layer of the tubular member(s) is preferably formed of a material which has physical properties which include relationship high values of tensile strength, modulus of elasticity, fatigue resistance, flexibility, resiliency, heat-sealability, and resistance to diffusion of gaseous fluids therethrough.

Considering the foregoing desired properties and requirements and the type of gaseous fluid (described below) preferably used to pressurize the tubular members, it has been found that materials which are suitable for the inner layer of the tubular members include the following: polyurethane, polyester elastomer (e.g., Hytrel), fluoroelastomer (e.g., Vitron), chlorinated polyethylene (CPE), polyvinyl chloride (PVC) with special plasticizers, chlorosulfonated polyethylene (e.g. Hypalon), polyethylene/ethylene vinyl acetate (EVA) copolymer (e.g. Ultrathane), neoprene, butadiene acrylonitrile rubber (Buna N), butadiene styrene rubber (e.g., SBR, GR-S, Buna-S), ethyiene propylene polymer (e.g., Nordel), natural rubber, high strength silicone rubber, polyethylene (low density), adduct rubber, sulfide rubber, methyl rubber, thermoplastic rubbers (e.g., Kraton).

The outer layer of the tubular member(s) is covered with mesh material which has physical properties which include resistance to expansion, high tenacity, low residual elongation, non-elasticity, flexibility and resiliency.

Considering the foregoing desired properties, it has been found that a filament fiber mesh type outer layer is suitable in restraining or preventing the inner elastomeric layer from expanding, ballooning, or deforming beyond the outer mesh layer when under gaseous fluid pressure. The filament fibers can suitably be formed from such materials as natural or synthetic fibers of, for example, polyester, nylon, polypropylene, rayon, acrylic, kevlar, cotton, wool or mixtures thereof. The mesh configuration of the filament fibers can be prepared by such techniques as braiding, weft knitting, winding, warp knitting and weaving as is well known. For simplicity of description, the terms mesh layer, fiber layer, or filament fibers as used herein and in the claims shall mean a fiber layer formed by such interlacing techniques.

In an alternate embodiment of the invention, tubular members can be provided with a second elastomeric layer covering the mesh layer whereby the second elastomeric layer forms the outer layer and the fiber layer forms the intermediate layer. The second layer of elastomeric material provides additional strength and impermeability to gaseous fluids, particularly when the tubular members are subjected to high pressurizations of gases. Additionally, the second elastomeric layer can be formed of a material different from the inner elastomeric layer, but which provides better adhesion to the fiber layer and the sole matrix material described below. When more than one gas is used to pressurize the tubular member, elastomer material selected for the outer layer can be impermeable to those gases for which the inner elastomer layer is not whereby the inner and outer elastomer layer compliment each other to provide complete impermeability to all gases employed.

One of the advantages of the sole construction of the present invention is that the pressurized tubular members can be embedded in a sole matrix in numerous configurations and combinations thereof to accommodate various uses and conditions of use by the user.

The tubular members can be constructed and arranged to run lengthwise (toe to heel), transversely (crosswise), or diagonally in parallel sections of different length to conform to the desired shape of the sole and then embedded in a sole matrix to form a permanent sole construction which is then attached to the upper part of the shoe. In another embodiment, the tubular members can be formed as tapered members which are particularly suitable in the arch section of the sole and in certain orthopedic applications.

The tubular members are arranged in a desired configuration and encapsulated in a suitable sole matrix material as described hereinafter. When the sole structure of the present invention is employed as an insole or insert for footwear, the sole matrix material can be a material which is elastomeric and permeable or foamed elastomeric material formed by conventional injection molding techniques. Such matrix materials are breathable, i.e., they allow ambient air to pass therethrough. The matrix material can also be formed as an impermeable elastomer. Suitable matrix materials of the elastic foam type include polyurethanes, ethyienevinylacetate/polyethylene copolymer, ethyienevinylacetate/polypropylene copolymer, neoprene and polyester.

BRIEF DESCRIPTION OF THE DRAWING(S)

For a fuller understanding of the nature and desired objects of the invention, reference should be had to the following detailed description taken in connection with the accompanying drawings wherein like reference characters denote corresponding parts throughout the several views and wherein.

DETAILED DESCRIPTION OF PREFERRED EMBODIMENTS

Figure 1:
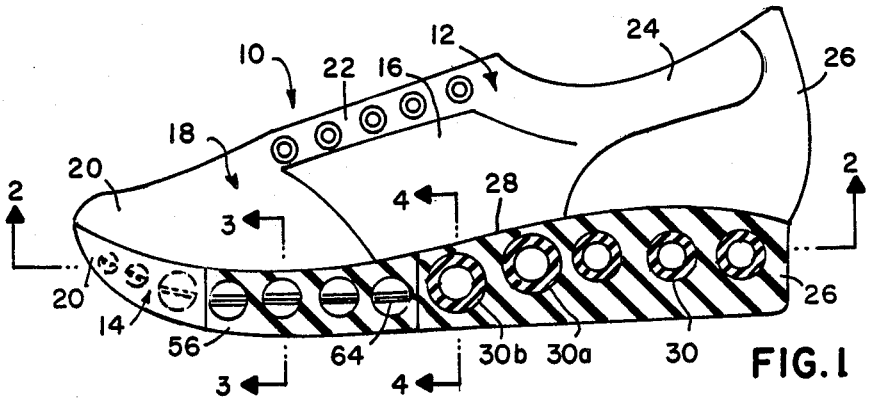
FIG. 1 is a side elevational view of an athletic shoe including a sole in accordance with the present invention with the sole shown partly in cross-section with the depth of the cross-sectional view shown generally by the line D—D of FIG. 2.

Referring now to the drawings and more particularly to FIGS. 1–9, there is shown an embodiment of a sole structure in accordance with the present invention adapted for use in an article of footwear such as an athletic type shoe shown generally at 10 in FIG. 1. The shoe 10 includes a shoe upper 12 to which a sole 14 is attached. The upper 12 can be formed of woven synthetic fiber 16 with externally sewn leather or leather-like reinforcements 18 in and around the toe area 20, the area 22 for the lacing eyelets, the top of the shoe area 24 and the heel area 26.

The sole 14 extends the length of the shoe being thinnest at the forefoot or toe region 20 and increasing or rising gradually through the arch region 28 to a well-elevated heel region 26.

Figure 2:
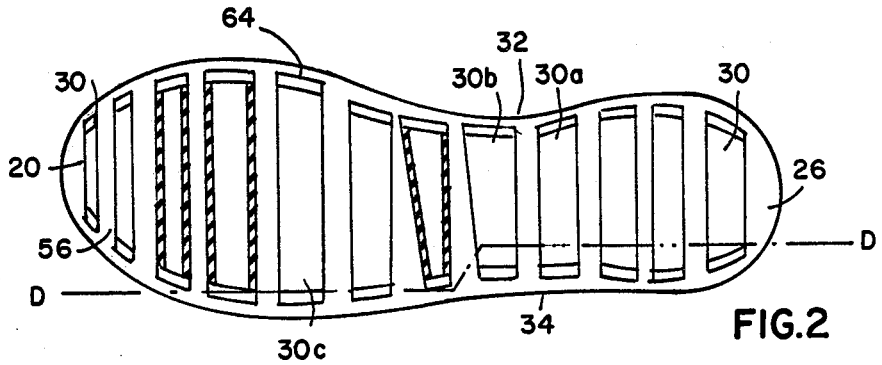
FIG. 2 is a sectional view taken generally along the line 2—2 of FIG. 1 but showing some of the tubular members in sectional view and some in perspective view.
Figure 3:
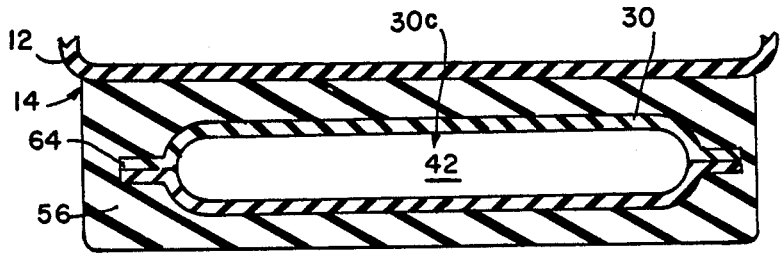
FIG. 3 is a sectional view taken generally along the line 3—3 of FIG. 1.
Figure 4:
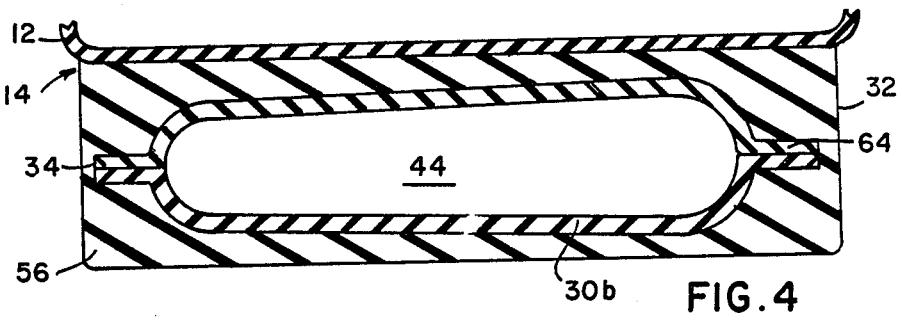
FIG. 4 is a sectional view taken generally along the line 4—4 of FIG. 1.
Figure 7:
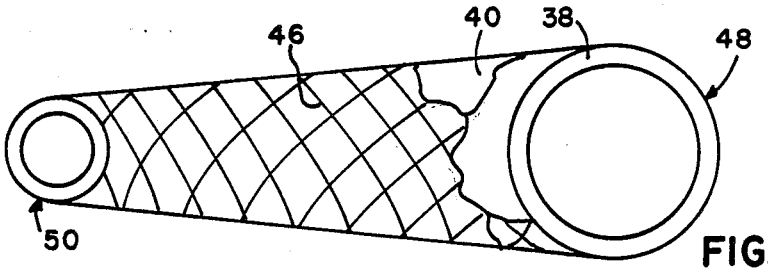
FIG. 7 is a fragmentary side perspective view of an alternate configuration of a tubular member in accordance with the present invention.

The shock attenuating sole structure 14 comprises a plurality of tubular members 30 which are positioned in spaced generally parallel relationship to each other from the toe region 20 to the heel region 26. The tubular members 30 are adapted to contain a gaseous fluid under pressure at a desired selected value. In accordance with the present invention, the tubular members 30 can be provided with various configurations. For example, the tubular members **30*a* and 30*b* are provided with a tapered configuration (as best seen in FIGS. 4 and 7) decreasing in size or volume from the inner arch area 32 to the outer arch area 34 (FIGS. 2 and 4). Similarly the tubular members can be provided with a constant size or volume such as 30*c* of FIGS. 2 and 3. As can be seen in FIGS. 1 and 2, the length of the tubular members 30** can be varied to conform to the configuration of the sole. Also the size or volume of the tubular members can be varied with the size increasing in areas which are effected most by shock forces which for example, generally progress from a minimum of near zero at the toe or forefoot region to variable maximum levels through the remainder of the sole.

Figure 5:
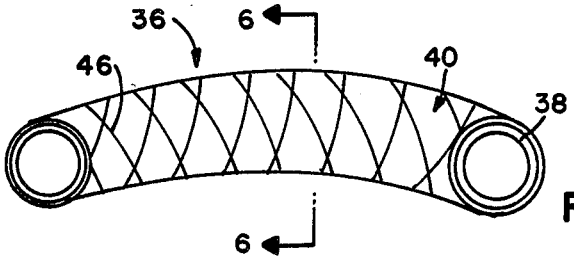
FIG. 5 is a fragmentary side perspective view of one embodiment of a tubular member in accordance with the invention.
Figure 6:
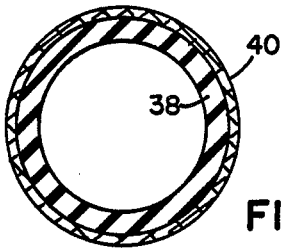
FIG. 6 is a sectional view taken generally along the line 6—6 of FIG. 5.

Referring now more particularly to FIGS. 5 and 6, there is illustrated one embodiment of a tubular member in accordance with the present invention. As shown, the tubular member 36 has a composite structure comprising an inner layer 38 formed of a flexible resilient elastomeric material which is impermeable to diffusion of gaseous fluids therethrough, and an outer layer 40 which is resistant to any expansion beyond the predetermined maximum volume of the chamber (for example, chambers 42 and 44 of FIGS. 3 and 4) when subjected to a desired gaseous pressure, but having sufficient compliant inward yieldability to cooperate with the inner resilient layer 38 to provide a cushioning effect or shock attenuation in response to shock forces. As described hereinbefore, the layer 40 is formed of filament fibers 46 which are interlaced by various techniques to form a fiber mesh or web which is resistant to expansion. The flexibility of the filament fiber layer can be varied as a function of fiber material and thickness as well as the density or thickness of the fiber mesh.

In FIG. 7 there is shown a modified embodiment of the tubular member wherein the composite structure is the same as FIG. 5 except the tubular configuration tapers from the large end 48 to a smaller end 50.

Figure 8:
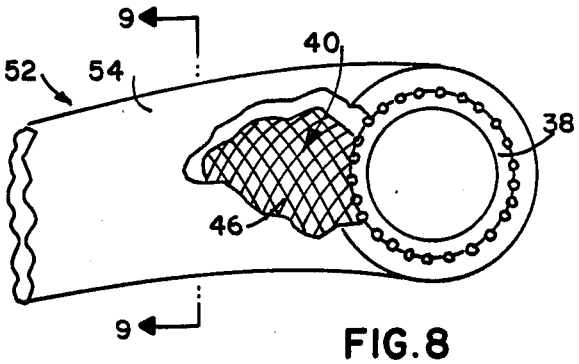
FIG. 8 is a fragmentary side perspective view of another embodiment of the tubular member in accordance with the present invention.
Figure 9:
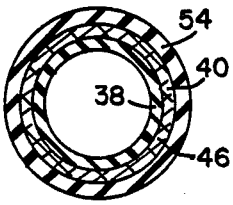
FIG. 9 is a sectional view taken generally along the line 9—9 of FIG. 8.

Referring now to FIGS. 8 and 9, there is shown an alternate embodiment of the composite structure of the tubular members. As illustrated, the tubular member 52 has the same composite structure as the tubular member 36 of FIG. 5 except that a second elastomeric layer 54 is provided over the filament fiber mesh layer 40 whereby the elastomeric layer 54 becomes the outer layer and the fiber mesh layer 40 becomes the intermediate layer. The outer elastomeric layer can be applied by extrusion molding techniques under sufficient temperature and pressure to cause the elastomer to permeate the spaces between the fibers of the intermediate mesh layer 40 and interlock with the inner elastomeric layer. The outer elastomeric layer as discussed hereinbefore can provide additional strength and resistance to expansion forces of the contained pressurized gaseous fluids of the inner layer in addition to greater compatibility of adhesion with the sole matrix material 56 as described hereinafter than provided by certain filament fiber meshes and compliment the inner layer in resistance to diffusion of gases.

A tubular member formed in this manner is characterized (1) by resistance to expansion or ballooning, (2) by variable selected compliant yieldability values, (3) variable selected flexibility, and (4) a wide range of tubular configurations.

Figure 10:
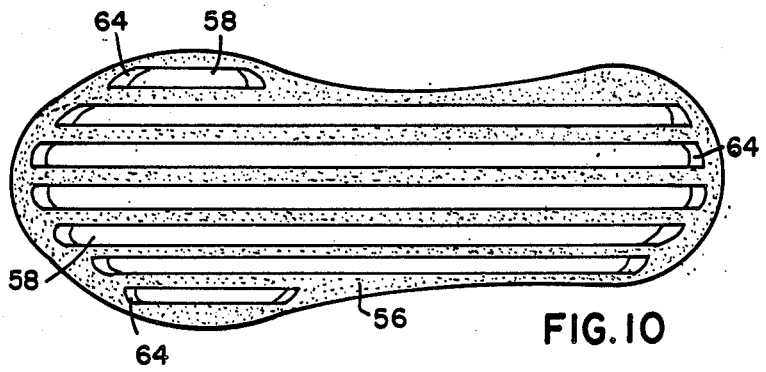
FIG. 10 is a top plan view of an alternate embodiment of a sole construction in accordance with the present invention showing a plurality of tubular members under fluid pressure in lengthwise (toe to heel) parallel relationship with the lower portion partially enclosed in a resilient sole matrix.
Figure 11:
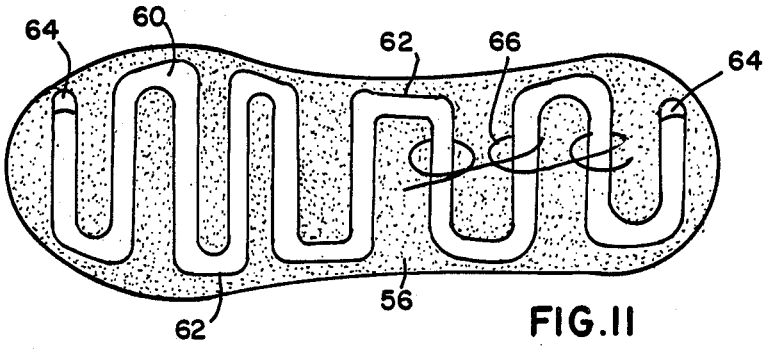
FIG. 11 is a top plan view of another embodiment of a sole construction in accordance with the present invention showing the tubular member under fluid pressure and in a continuous serpentine-like configuration with the lower portion partially enclosed in a resilient sole matrix.
Figure 12:
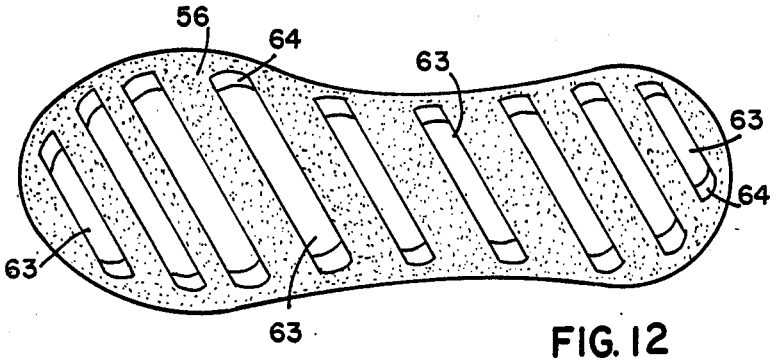
FIG. 12 is a top plan view of an alternate embodiment of a sole construction in accordance with the present invention showing a plurality of tubular members under fluid pressure in diagonal parallel relationship with the lower portion partially enclosed in a resilient sole matrix.

Referring now to FIGS. 10, 11 and 12, there are shown alternate embodiments of the configuration of the tubular members in the sole matrix. In FIG. 10 the tubular members 58 are embedded or encapsulated in the sole matrix 56 in lengthwise (toe to heel) positions and in varying lengths to conform to the configuration of the sole matrix. In FIG. 11 the tubular member 60 consists of a single continuous tubular member positioned in the sole matrix in a zig-zag or serpentine configuration with the peripheral edge portions 62 conforming generally to the configuration of the sole matrix 56. In FIG. 12 the tubular members 63 are embedded in the sole matrix 56 in a diagonal parallel spaced relationship in varying lengths to conform to the sole configuration.

Figure 13:
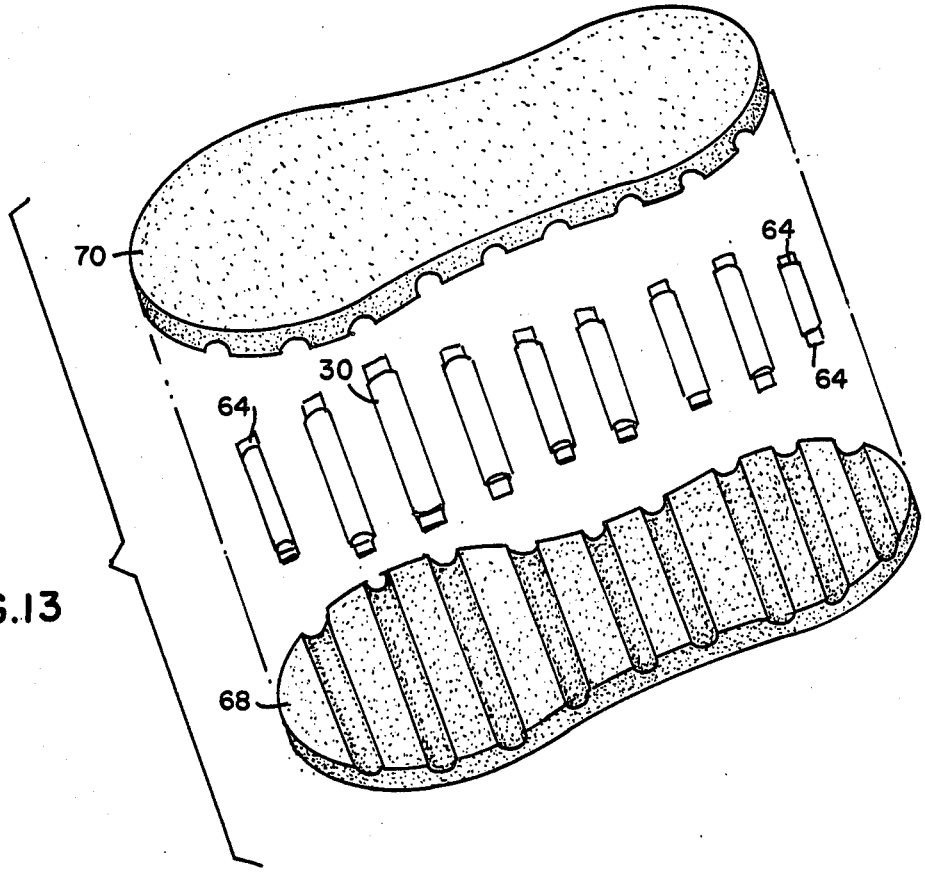
FIG. 13 is an exploded view of a sole construction of the type shown in FIG. 1 illustrating the encapsulation of the transverse tubular members under fluid pressure by the upper and lower resilient sole matrix sections.
Figure 14:
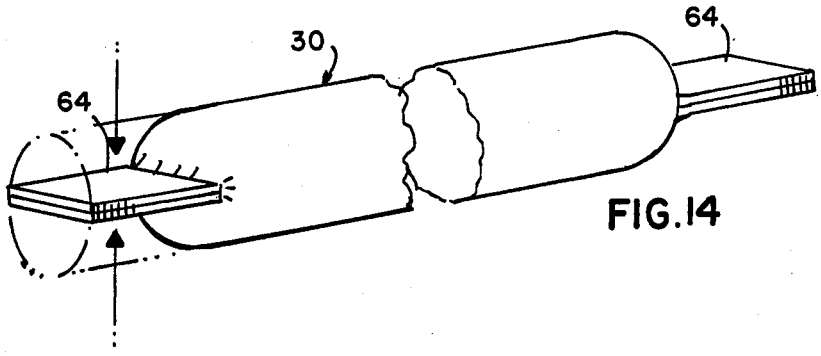
FIG. 14 is a fragmentary perspective view of a tubular member illustrating the sealed end.
Figure 15:
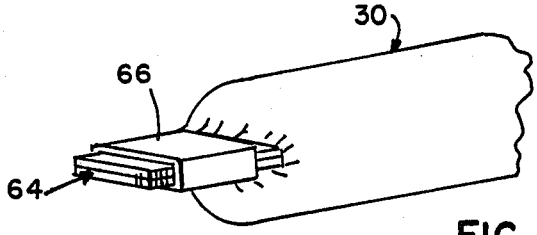
FIG. 15 is a fragmentary perspective view of the tubular member of FIG. 14 showing the addition of a clamping member to the sealed end.

Referring now to FIGS. 13–15, the tubular members 30 are cut to the desired lengths by conventional methods such as die/melt cutting, ultra sound, or melt cut systems employing lasers. The sealed ends 64 of the tubular members 30 are formed by conventional methods such as compressing the ends together (as shown by the dotted line and arrows of FIG. 14 for example) and heat sealing the ends to form the sealed end 64. The tubular members can be pressurized with a gaseous fluid to the desired initial value as part of the end sealing process. In applications where the pressurized level of the gaseous fluid is higher than average, such as in high level athletic endeavors, an additional sealing means such as a metal clamp 66 can be employed. It is to be understood that other conventional sealing means, such as adhesives, glues and the like can be employed.

Referring now to FIG. 13, a typical sole structure such as 14 of FIG. 1 is shown in three sections for simplicity of discussion namely: a lower sole matrix section 68; tubular members 30; and the upper sole matrix section 7 In forming the sole structure the pressurized and sealed tubular members 30 can be supported within a suitable mold (not shown) with the desired pacing between the tubular members. The sole matrix material such as a natural or synthetic elastomer is then injected into the mold cavity to encapsulate the tubular members 3 The elastomeric matrix is allowed to cure and bond to the tubular members to form the completed sole structure. It is to be understood that other methods of fabrication can be employed. For example, the unsealed, uninflated tubular members can be encapsulated in the sole matrix and thereafter cut to the sole configuration, sealed and pressurized. When it is desired to foam the elastomeric matrix material, a suitable foaming agent and catalyst can be injected into the mold cavity as is well known to form such a foamed elastomeric matrix.

The sole structure of the present invention can be adapted to be used as a complete sole, as an insole, as an insert or embodied in a midsole or outsole. When the sole structure of the present invention is employed as an insole, for example, an outer sole such as the type described in U.S. Pat. No. 4,439,936 can be employed.

It has been found that many activities can be accommodated when the tubular members are inflated to a pressure of between about 2 psi and about 120 psi. Of course, the use of the article of footwear in which the improved sole structure construction of the present invention is incorporated will determine the optimum pressure to which the sole structure should be inflated. For example, if the sole structure is to be employed in a pair of track shoes for a runner, the sole structure should be inflated to a higher pressure than if the sole structure construction is to be employed in a pair of ordinary street shoes. For low level athletic endeavors (e.g., walking), the pressure to which the tubular members of the sole structure should be inflated is between about 18 and 40 psi. For high level athletic endeavors, the inflation pressure should be between about 30 and 120 psi. For ordinary street shoes, the inflation pressure should be between about 12 and 30 psi.

The gaseous fluids which can be employed to fill the pressurized tubular members 30 of the sole structure should preferably be a gas which will not diffuse appreciably through the walls of the tubular member material for an extended period of time (e.g., several years).

The two most desirable gases have been found to be hexafluorethane (e.g., Freon F-116) and sulfur hexafluoride.

Other gases which have been found to be acceptable, although not as good as hexafluorethane and sulfur hexafluoride, are as follows: perfluoropropane, perfluorobutane, perfluoropentane. perfluorohexane, perfluoroheptane, perfluorocyclobutane, octafluorocyclobutane, hexafluoropropylene, tetrafluoromethane (e.g., Freon F-14), monochloropentafluoroethane (e.g., Freon F-115), and other Freon gases known as Freon 114, Freon 113, Freon 13 B-1, and Freon 13. It is to be understood that while the foregoing gases are preferred, other gases such as air, oxygen, nitrogen and mixtures of such gases can be employed.

Additionally, the invention contemplates the provision of a second mesh layer adjacent the first mesh layer where additional resistance to expansion is required.

Referring again to FIG. 11, the present invention also contemplates a further embodiment of the invention wherein the elastomeric tube 62 is provided with pillars 66 for added restraint to maintain the tubular member 62 in the desired serpentine-like configuration. The pillars 66 can be made of any textile yarn or filament and applied (as shown only on a portion of the tubular member 62 for illustrative purposes) to the U-shaped portions of the tubular member 62 by warp knitting techniques, for example.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

What is claimed is:

1. A sole structure for footwear and the like comprising:

a plurality of adjacent tubular members adapted to contain a gaseous medium under pressure at a selected value;

said tubular members having a composite structure comprising:

an inner layer of resilient material substantially completely impermeable to diffusion of said gaseous medium therethrough; and an outer layer of a flexible mesh material completely surrounding said inner layer;

said outer layer being resistant to expansion but sufficiently compliant to cooperate with said inner resilient layer to provide a cushioning effect in response to shock forces; and a resilient flexible material forming a matrix about said tubular members.

2. A sole structure for footwear and the like having a heel section, a forefoot section and a toe section; said sole structure comprising:

a plurality of adjacent tubular members adapted to contain a gaseous medium under pressure at a selected value;

said tubular members having a composite structure comprising:

an inner layer of resilient material substantially completely impermeable to diffusion of said gaseous medium therethrough; and an outer layer of a flexible mesh material completely surrounding the inner layer of each tubular member;

said outer layer being resistant to expansion whereby the volume of the tubular members when subjected to increased gaseous pressure values is limited to the volume of the outer layer but sufficiently compliant to cooperate with said inner resilient layer to provide a cushioning effect in response to shock forces; and a resilient flexible material forming a matrix about said tubular members.

3. The sole structure of claim 2 wherein said inner layer of resilient flexible material is formed of an elastomeric material.

4. The sole structure of claim 2 wherein said outer layer of flexible mesh material comprises at least one layer of interlaced filament fibers.

5. The sole structure of claim 2 wherein said sealed tubular members are positioned in a transverse spaced relationship throughout said sole structure.

6. The sole structure of claim 2 wherein said sealed tubular members are positioned in a lengthwise spaced relationship throughout said sole structure.

7. The sole structure of claim 2 wherein said sealed tubular members are positioned in a diagonal spaced relationship throughout said sole structure.

8. The sole structure of claim 2 further comprising at least one tapered tubular member positioned in said arch section and decreasing in taper from the inside to the outside of said arch section.

9. The sole structure of claim 2 wherein the selected gas pressure values of the sealed tubular members provide for a varied cushioning effect throughout the sole structure in response to the level of shock forces received by said sole structure.

10. The sole structure of claim 2 wherein the length and diameter of said sealed tubular members correspond to the configuration of the heel, arch, forefoot and toe sections of said sole structure and the shock forces received thereon.

11. The sole structure of claim 2 wherein the tubular members are formed of adjacent sections of a continuous elongated sealed tubular member positioned in a serpentine-like configuration conforming to the configuration of said sole structure.

12. The sole structure of claim 11 wherein said adjacent sections of the tubular member are held in position by interlaced fiber members.

13. The sole structure of claim 2 wherein said sealed tubular members contain a gaseous medium at a pressure of between about 2 psi to 120 psi.

14. The sole structure of claim 2 wherein the said sole matrix is formed of an elastomeric material.

15. A sole structure for footwear and the like comprising:

a plurality of spaced tubular members adapted to contain a gaseous medium under pressure at a desired initial selected value and having peripheral edges which conform generally to the contour of a selected sole configuration;

said tubular members having a composite structure comprising:

an inner layer of resilient elastomeric material substantially completely impermeable to diffusion of gaseous fluids therethrough; and an intermediate layer of a flexible fiber mesh material substantially completely resistant to expansion but sufficiently compliant to cooperate with said inner resilient layer to provide a cushioning effect in response to shock forces;

an outer layer of resilient elastomeric material covering said flexible fiber mesh and having portions thereof permeating through said fiber mesh and contacting said inner elastomeric layer;

said outer layer being substantially completely impermeable to diffusion of gaseous fluids therethrough; and a resilient material forming a matrix about said tubular members.

16. The sole structure of claim 15 wherein said outer layer of flexible mesh material comprises at least one layer of interlaced filament fibers.

17. The sole structure of claim 15 wherein said sealed tubular members are positioned in a transverse spaced relationship throughout said sole structure.

18. The sole structure of claim 15 wherein said sealed tubular members are positioned in a lengthwise spaced relationship throughout said sole structure.

19. The sole structure of claim 15 wherein said sealed tubular members are positioned in a diagonal spaced relationship throughout said sole structure.

20. The sole structure of claim 15 further comprising at least one tapered tubular member positioned in said arch section and decreasing in taper from the inside to the outside of said arch section.

21. The sole structure of claim 2 wherein the selected gas pressure values of the sealed tubular members provide for a varied cushioning effect throughout the sole structure in response to the level of shock forces received by said sole structure.

22. The sole structure of claim 15 wherein the length and diameter of said sealed tubular members correspond to the configuration of the heel, arch, forefoot and toe sections of said sole structure and the shock forces received thereon.

23. The sole structure of claim 15 wherein the tubular members are formed of adjacent sections of a continuous elongated sealed tubular member positioned in a serpentine-like configuration conforming to the configuration of said sole structure.

24. The sole structure of claim 23 wherein said adjacent sections of the tubular member are held in position by interlaced fiber members.

25. The sole structure of claim 15 wherein said sealed tubular members contain a gaseous medium at a pressure of between about 2 psi to 120 psi.

26. The sole structure of claim 15 wherein the said sole matrix is formed of an elastomeric material.

27. A sole structure for footwear and the like having a heel section, an arch section, a forefoot section and a toe section; said sole structure comprising:

a plurality of sealed tubular members adapted to contain a gaseous medium under pressure at a selected value;

said tubular members having a composite structure comprising:

an inner layer of resilient flexible material impermeable to diffusion of said gaseous medium therethrough;

an outer layer of a flexible mesh material substantially completely resistant to expansion but sufficiently compliant to cooperate with said inner resilient layer to provide a cushioning effect in response to shock forces applied to said sole structure;

at least one tapered tubular member positioned in the arch section and decreasing in taper from the inside to the outside of said arch section; and a resilient flexible material forming a matrix about said tubular members.

28. A sole structure for footwear and the like having a heel section, an arch section, a forefoot section and a toe section; said sole structure comprising:

a plurality of sealed tubular members adapted to contain a gaseous medium under pressure at a selected value formed of adjacent sections of a continuous elongated sealed tubular member positioned in a serpentine-like configuration conforming over all to the configuration of said sole structure;

said elongated tubular member having a composite structure comprising:

an inner layer of resilient flexible material impermeable to diffusion of said gaseous medium therethrough;

an outer layer of a flexible mesh material substantially completely resistant to expansion but sufficiently compliant to cooperate with said inner resilient layer to provide a cushioning effect in response to shock forces applied to said sole structure;

said adjacent sections of the tubular member being held in position by interlaced fiber members; and a resilient flexible material forming a matrix about said tubular members.

* * * * *